US005737882A

United States Patent [19]

Eckert et al.

[11] Patent Number: 5,737,882

[45] Date of Patent: Apr. 14, 1998

[54] APPARATUS AND METHOD FOR ATTACHING A ROOF TO A BUILDING

[75] Inventors: John F. Eckert, San Rafael; Jorge R. de Quesada, San Francisco, both of Calif.

[73] Assignee: International Village, Inc., Austin, Tex.

[21] Appl. No.: 636,573

[22] Filed: Apr. 23, 1996

[51] Int. Cl.[6] ..... E04B 7/04; E04B 7/16

[52] U.S. Cl. ..... 52/93.2; 52/92.2; 52/71; 52/639; 52/640; 52/641; 52/646; 52/712; 52/745.2

[58] Field of Search ..... 52/71, 92.2, 93.2, 52/639, 641, 640, 646, 712, 745.2; 403/232.1

[56] References Cited

U.S. PATENT DOCUMENTS

| | | | |
|---|---|---|---|
| 3,256,030 | 6/1966 | Banse | 52/712 |
| 3,774,356 | 11/1973 | Philp . | |
| 3,785,108 | 1/1974 | Satchell . | |
| 4,078,353 | 3/1978 | Thesingh | 52/92.2 X |
| 4,170,852 | 10/1979 | Danis . | |
| 4,296,576 | 10/1981 | Rice et al. . | |
| 4,410,294 | 10/1983 | Gilb et al. . | |
| 4,572,695 | 2/1986 | Gilb | 403/232.1 |
| 4,669,235 | 6/1987 | Reinen . | |
| 4,878,323 | 11/1989 | Nelson . | |
| 4,932,173 | 6/1990 | Commins . | |
| 5,217,317 | 6/1993 | Young | 403/232.1 |
| 5,230,198 | 7/1993 | Callies . | |
| 5,335,469 | 8/1994 | Stuart . | |
| 5,380,115 | 1/1995 | Colonias . | |

*Primary Examiner*—Christopher Kent
*Attorney, Agent, or Firm*—Fish & Richardson P.C.

[57] ABSTRACT

A method of attaching to at least one bearing beam of a building. A clip with a blocking tab is attached to the bearing beam, and a roof assembly with two pivotally attached frames is unfolded and lowered. Each frame has a blocking member, and the roof is lowered so that the blocking member contacts the blocking tab and restrains the roof assembly from unfolding further. A roof has two parallel bearing beams, clips attached to each bearing beams, and a roof assembly. Each clip has a ramp and a blocking tab. The roof assembly has two pivotally attached frames, and each frame has a rafter and a blocking member. Each rafter rests on a ramp, and each blocking member is attached to a blocking tab.

16 Claims, 9 Drawing Sheets

APPARATUS AND METHOD FOR ATTACHING A ROOF TO A BUILDING

BACKGROUND OF THE INVENTION

The present invention relates generally to prefabricated roofing, and more particularly to roof clips for attaching a hinged roof assembly to a building frame.

A general objective of the building industry is to create low cost, easily constructed housing. Often, prefabricated light-weight steel frames are assembled in the field to create the walls of the dwelling. However, the addition of the roof to the dwelling remains a problem.

One possibility is to simply attach horizontal rafters to the tops of the side walls to create a flat roof. However, a sloped roof is aesthetically more pleasing than a flat roof, and can provide additional room in the dwelling or create a sense of openness.

One prior method of constructing a gabled roof, as shown in U.S. Pat. No. 3,774,356, is to use a prefabricated structure in which the roofing is already pivotally attached to the side walls. Unfortunately, structures in which the walls are pre-attached to the roof are very bulky and require the use of large trucks to carry to the field and heavy lifting machinery to assemble.

Another prior method of constructing a gabled roof, as shown in U.S. Pat. No. 4,878,323, is to use a prefabricated truss structure in which the trusses are snapped into place on top of the side walls. Unfortunately, the truss structure must be prefabricated for a specific roof angle and spacing between side walls. This increases the cost of producing the truss structures if a variety of different roofs are desired.

An additional problem with prior methods is that they use internal chords and cross-braces to hold the roof at a desired angle and prevent the roof from collapsing. Unfortunately, these chords and cross-braces effectively prevent the use of the top space of the dwelling as a loft for storage or living area.

SUMMARY OF THE INVENTION

According to one embodiment, the invention relates to a method of attaching to at least one bearing beam of a building. A clip with a blocking tab is attached to the bearing beam, and a roof assembly with two pivotally attached frames is unfolded and lowered. Each frame has a blocking member, and the roof is lowered so that the blocking member contacts the blocking tab and restrains the roof assembly from unfolding further.

According to another embodiment, the invention relates to a roof. The roof has two parallel bearing beams, a clip attached to each bearing beam, and a roof assembly. Each clip has a ramp and a blocking tab. The roof assembly has two pivotally attached frames, and each frame has a rafter and a blocking member. Each rafter rests on a ramp, and each blocking member is attached to a blocking tab.

The advantages of the invention include the following. The roof is sloped, low cost, prefabricated, and easy to assemble in the field with only four or five workers. The roof does not have internal cross-braces, so that room is available for a loft to expand the living area. The design is simple, light weight, and easy to fabricate. The roof is modular, so any length roof may be provided by attaching additional roof assemblies. The roof can withstand intense-force winds.

DESCRIPTION OF THE PREFERRED EMBODIMENTS

The present invention uses blocking members to engage roof clips and thereby provide a three point roof. In one embodiment, shown in FIG. 1B, the blocking member is a lateral bar which connects rafters. In another embodiment, shown in FIG. 12, the blocking member is a separate tab projecting from one of the rafters.

Figure 1A:
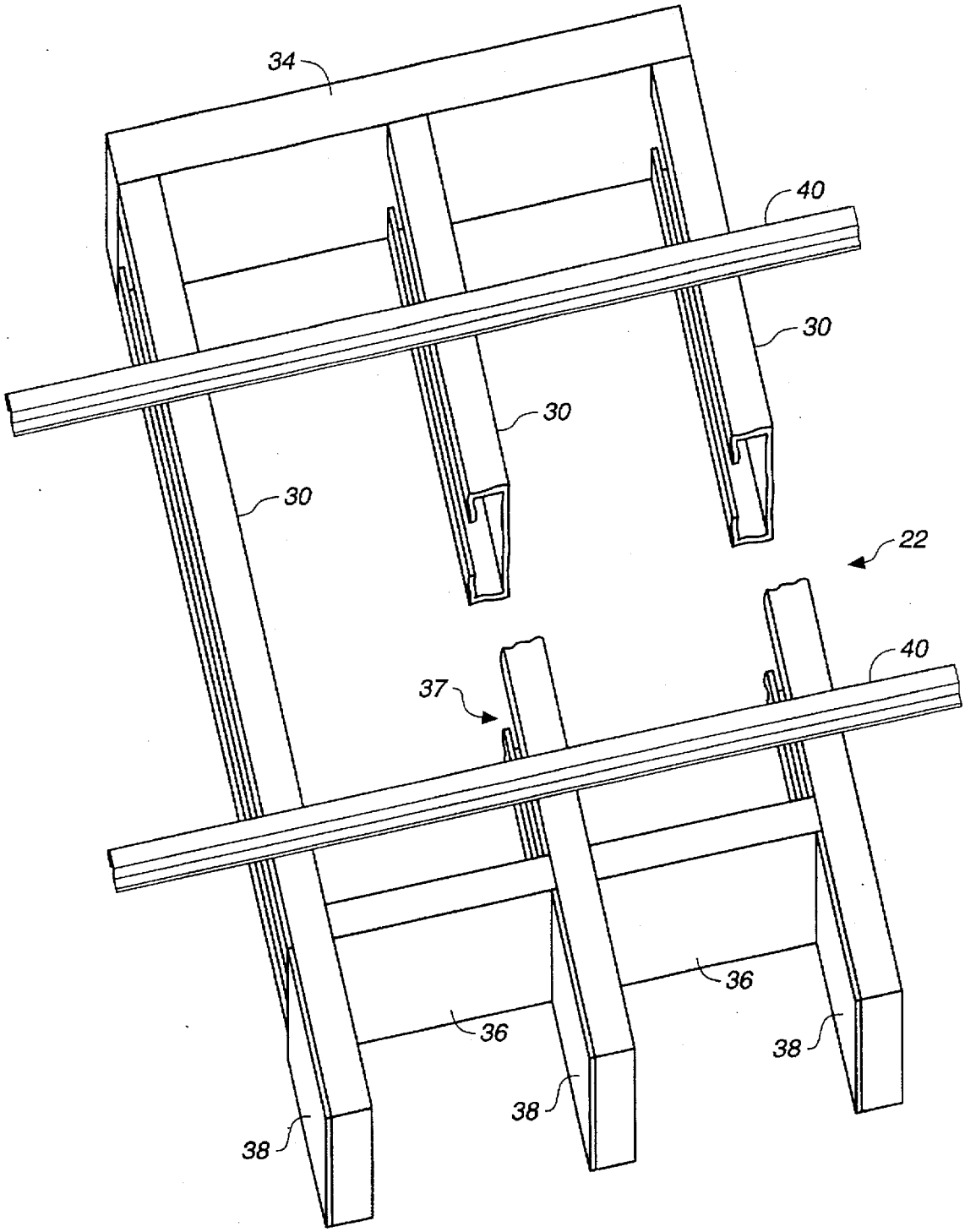
FIG. 1A is a perspective view of a foldable roof assembly.

As shown in FIG. 1A, a frame 22 has several parallel, spaced apart rafters 30 connected by a lateral upper bar 34 and a lateral lower blocking bar 36. Preferably, each frame 22 has three rafters 30. Each rafter 30 and blocking bar 36 may be a c-sectioned light gauge steel beam about two inches wide and four inches high. Lateral upper bar 34 may be a u-sectioned light gauge steel beam slightly wider than rafters 30. Below blocking bar 36, the open side 37 of c-shaped rafter 30 may be covered by a metal sheet 38. Each frame 22 may include additional lateral or diagonal supports to improve the structural strength of frame 22. The frame may also have purlins 40 attached to rafters 30 to support roofing material.

In the preferred embodiment, blocking bar 36 is disposed in the same plane as rafters 30 but projects at a right angle from rafters 30. Blocking bar 36 is positioned near the far end of rafter 30 from a hinge 27. Blocking bar 36 includes a contact surface which is preferably in a plane angled from the horizontal. The contact surface may be in a plane perpendicular to the plane in which rafters 30 are disposed.

Figure 1B:
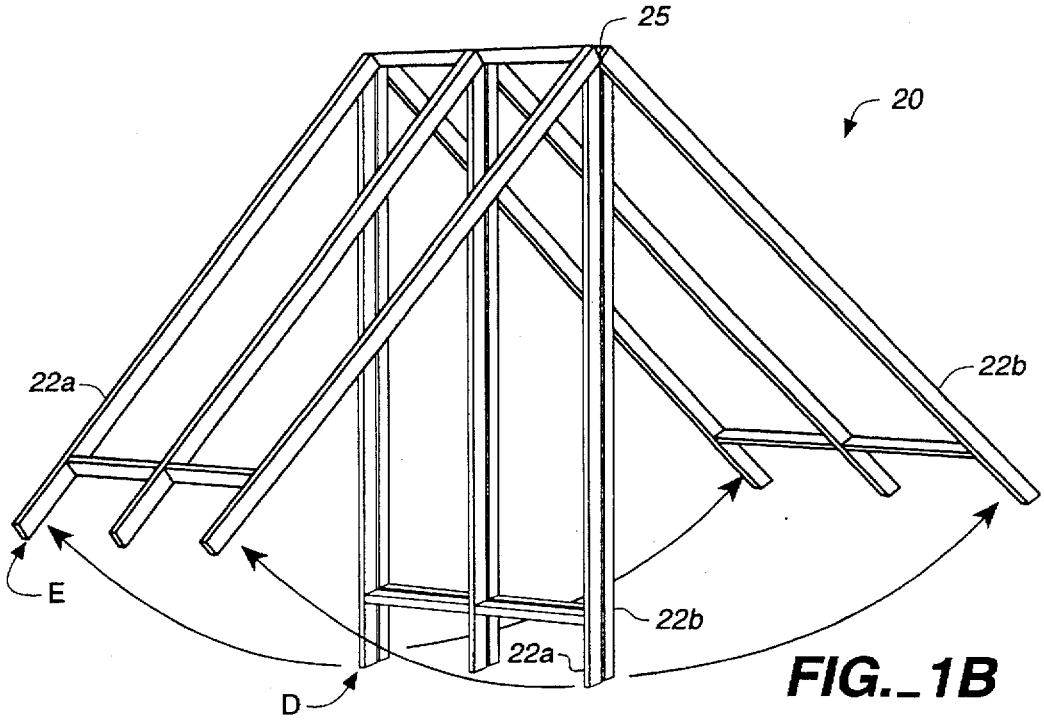
FIG. 1B is a perspective view of a roof frame.

As shown in FIG. 1B, a roof assembly 20 is constructed of two identical light gauge steel frames **22*a*, 22*b*. Frames 22*a*, 22*b* are pivotally attached together along a common edge 25 so that frames 22*a*, 22*b* may be opened to an angle up to 180°. Hinge 27 may be used to pivotally attach frames 22*a*, 22*b* (see FIG. 2). Roof assembly 20 is stored in a folded position indicated by arrow D, and unfolded to about a 106° angle, indicated by arrow E, when roof assembly 20** is to be lowered onto a building frame.

Figure 1C:
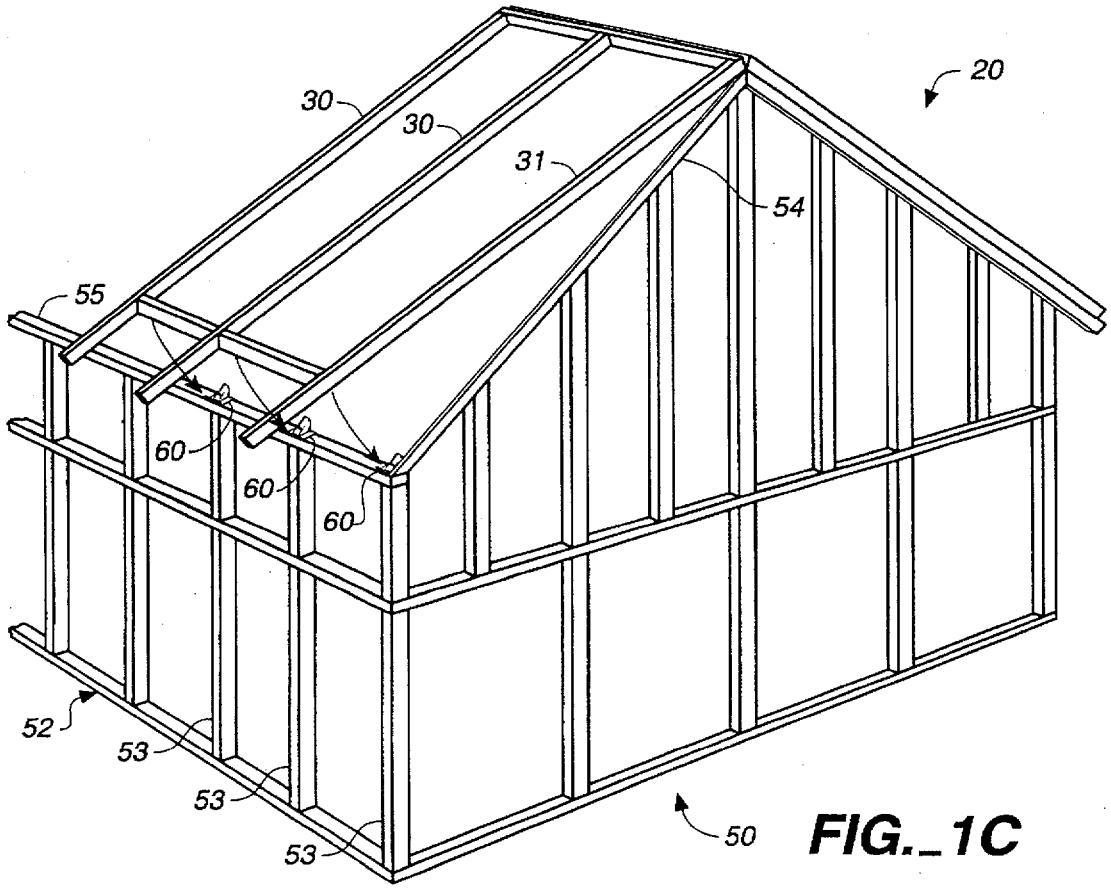
FIG. 1C is a perspective view showing a foldable roof assembly being lowered onto a building frame.

As shown in FIG. 1C, roof assembly 20 is lowered onto a building frame 50. Building frame 50 is preferably constructed of prefabricated components, including parallel side walls 52. Each side wall 52 includes a bearing beam 55 supported by vertical support studs 53. Building frame 50 may also include door and window frames, and criss-cross supports.

After side walls 52 are assembled, multiple roof clips 60 are attached to the top of bearing beam 55. Preferably, there is one roof clip 60 for each rafter 30. However, the outermost rafter 31, which is adjacent to the end wall, may be supported by an angled beam 54. Bearing beam 55 may include indents, marks, or projections to aid in the placement of roof clips 60 at the proper positions along bearing beam 55. In the preferred embodiment, self-tapping screws are inserted through holes in roof clip 60 to secure bearing beam 55 to roof clip 60.

Once roof assembly 20 is lowered onto building frame 50, rafters 30 may be aligned with and rest on roof clip 60. Roof clip 60 may be positioned above vertical support stud 53, although this is not required. In particular, there may be more vertical support studs 53 than rafters 30.

Depending on the length of side wall 52, more than one roof assembly 20 may be needed to complete the roof. The length of roof assembly 20 (and the number of rafters 30), is selected so that the total weight of roof assembly 20 can be handled comfortably by four or five workers, e.g. four-hundred to five-hundred pounds.

Figure 2:
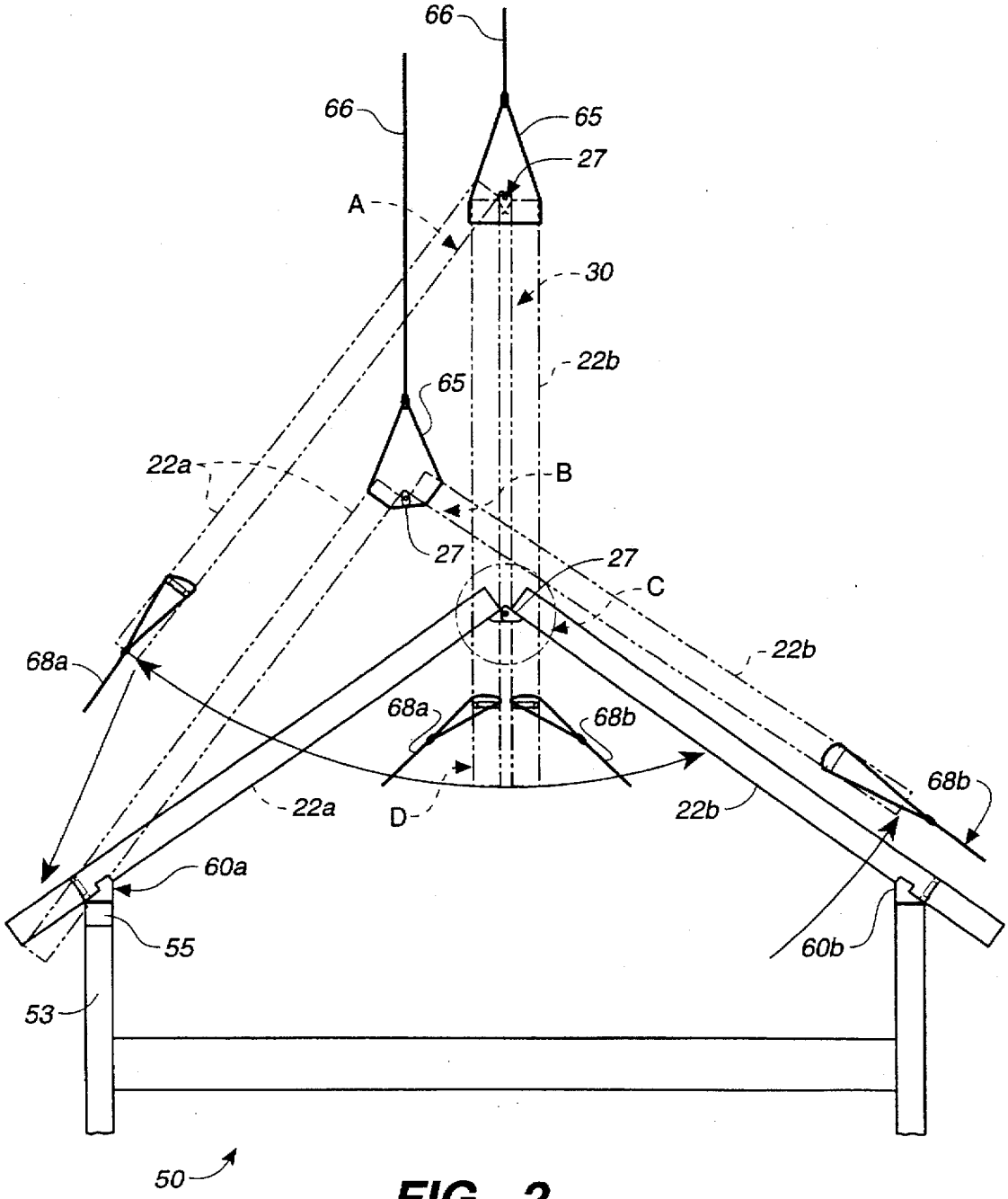
FIG. 2 is a side view showing a roof assembly being connected to the bearing beams of a side wall.

The method of constructing a roof will be explained with reference to FIG. 1C and 2. Each roof assembly 20 is delivered to the construction site in a folded, flat configuration. A strap or straps 65 is attached around lateral upper bars 34 of frames 22*a*, 22*b*. Strap 65 is connected by a line 66 to a lifting device, such as a boom crane or pulley system. Four tie lines are attached to the blocking bars 36 or rafters 30. Two tie lines 68*a* are connected to the outer edges of frame 22*a*, and two tie lines 68*b* are connected to the outer edges of frame 22*b*. The lifting device raises roof assembly 20 above side walls 52, and the lifting device or the workers can swing roof assembly 20 over the building frame 50. Then, using tie lines 68*a* and 68*b*, workers pull frame 22*a* apart from frame 22*b* to the position indicated by arrow A. Then line 66 is lowered and the workers guide frame 22*a* to the position indicated by arrow B so that rafters 30*a* rest on clips 60*a* and the blocking bar engages and aligns with clip 60*a*. Frame 22*a* may then be temporarily secured to bearing beam 55*a* by a clamp or rope. Then, as indicated by arrow C, workers maneuver frame 22*b* into position with tie line 68*b* so that rafters 30*b* rest on clips 60*b*, and the blocking bar engages and aligns with the clips 60*b*. Finally, frames 22*a*, 22*b* are fastened in place, and strap 65 and lines 66, 68*a*, and 68*b* are removed.

Once roof assembly 20 has been attached to building frame 50, roofing material may be mounted on purlins 40 that are fastened to rafters 30. Light gauge steel sheets, tiles, or composite roofing can be attached directly to the purlins to cover the roof and complete the building.

Figure 3:
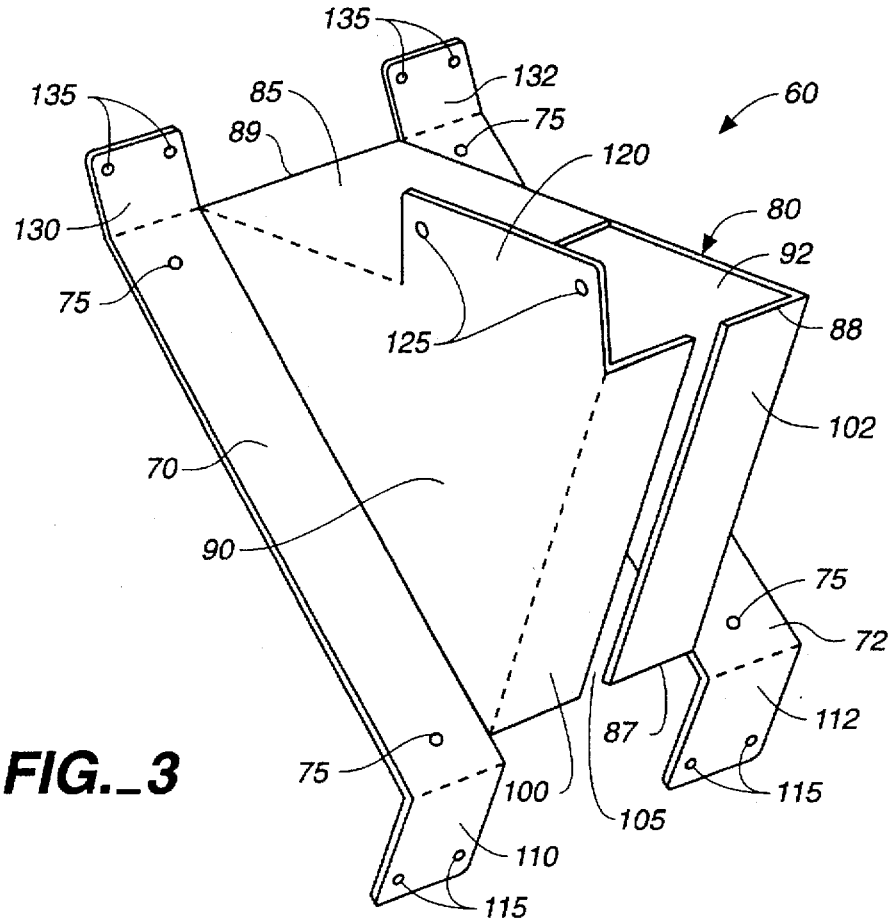
FIG. 3 is a perspective view of a roof clip.

As shown in FIG. 3, roof clip 60 is sheet metal bracket with two horizontal plates 70 and 72 that rest on the top of a bearing beam. Between plates 72 and 72 is a fixed pitch ramp 80 which may be manufactured in a variety of roof pitches to support a rafter. Ramp 80 has a bearing surface 85 which is angled (e.g., thirty-seven degrees) compared to the horizonal plates 72 and 74. Two sides 90 and 92 connect bearing surface 85 to horizontal plates 70 and 72. The vertical side of ramp 80 below inner edge 88 has two vertical wall tabs 100 and 102, which have a gap 105 therebetween. The base 87 of wall tabs 100 and 102 is flush with the bottom side of plates 70 and 72 and rests on bearing beam 55 to support ramp 80.

Two vertical holding tabs 110 and 112 project downward at a right angle from plates 70 and 72, respectively, to retain clip 60 and prevent it from slipping outward under pressure from roof assembly 20. Holding tabs 110 and 112 are located beyond, but parallel to, base 87 of ramp 80 so that when holding tabs 110 and 112 are pressed against an inner surface of bearing beam 55, plates 70 and 72 and the base 87 of wall tabs 100 and 102 rest on the top surface of the bearing beam.

One of the sides of ramp 80, for example, side 90, projects up beyond bearing surface 85 to form a vertical securing tab 120. The rafter which rests on bearing surface 85 of ramp 80 may be secured against lateral motion by attaching it to vertical securing tab 120. Vertical securing tab 120 also secures rafter 30 against upward lift, such as that caused by intense wind.

Two blocking tabs 130 and 132 project upward at an angle, such as 143°, from plates 70 and 72, respectfully, at inner edge 89 of ramp 80. Blocking tabs 130 and 132 serve to engage blocking bar 36 and prevent roof assembly 20 from slipping outward. Preferably, blocking tabs 130 and 132 form a right angle with bearing surface 85. It may be noted that if bearing surface 85 forms an angle $\alpha$ with plates 70 and 72, then the angle between blocking tab 130 and 132 and plates 70 and 72 will be $90+\alpha$.

Figure 4:
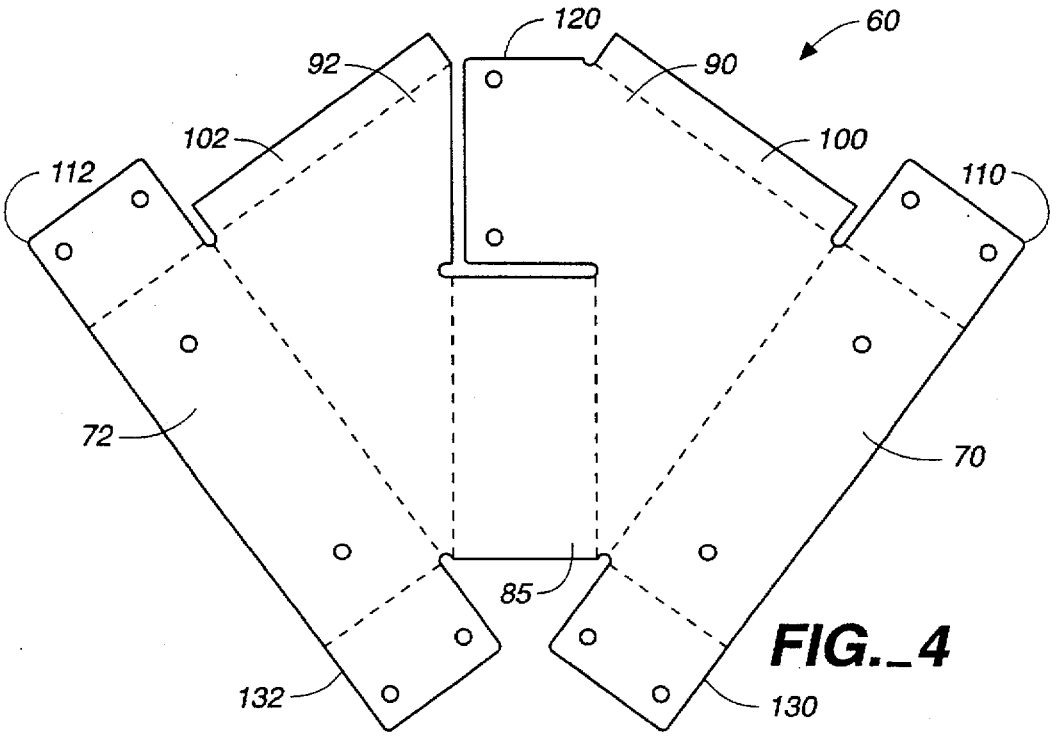
FIG. 4 is a top view of an unfolded roof clip.

As shown in FIG. 4, roof clip 60 may be cut or stamped from a single flat metal sheet and then folded to form its final shape. Roof clip 60 is preferably sixteen or eighteen gauge sheet steel with a galvanized or primed and painted finish.

Figure 5:
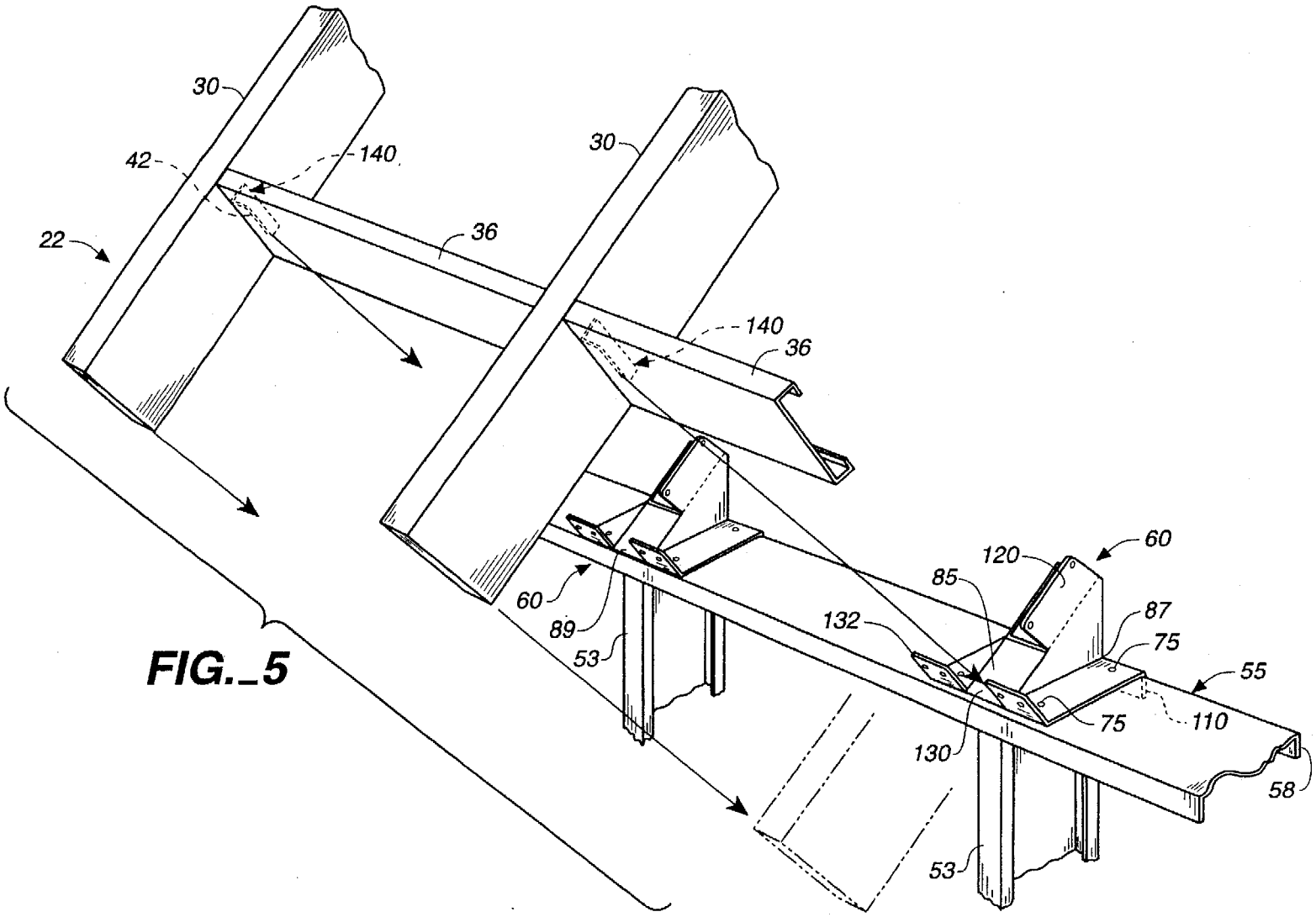
FIG. 5 is a perspective view showing of a blocking member being maneuvered into roof clips.

As shown in FIG. 5, frame 22 is maneuvered so that rafter 30 abuts vertical securing tab 120 and fits between blocking tabs 130 and 132. Then frame 22 is lowered so that rafter 30 rests on bearing surface 85 of ramp 80. When the tension on frame 22 is released, rafter 30 will slip down ramp 80 until contact surface 42 of blocking bar 36 contacts blocking tabs 130 and 132. Contact surface 42 of blocking bar 36 is parallel to the plane of blocking tabs 130, 132 to ensure a secure fit. The combination of ramp 80 and blocking tabs 130, 132 hold roof assembly 20 in the proper position.

Figure 7:
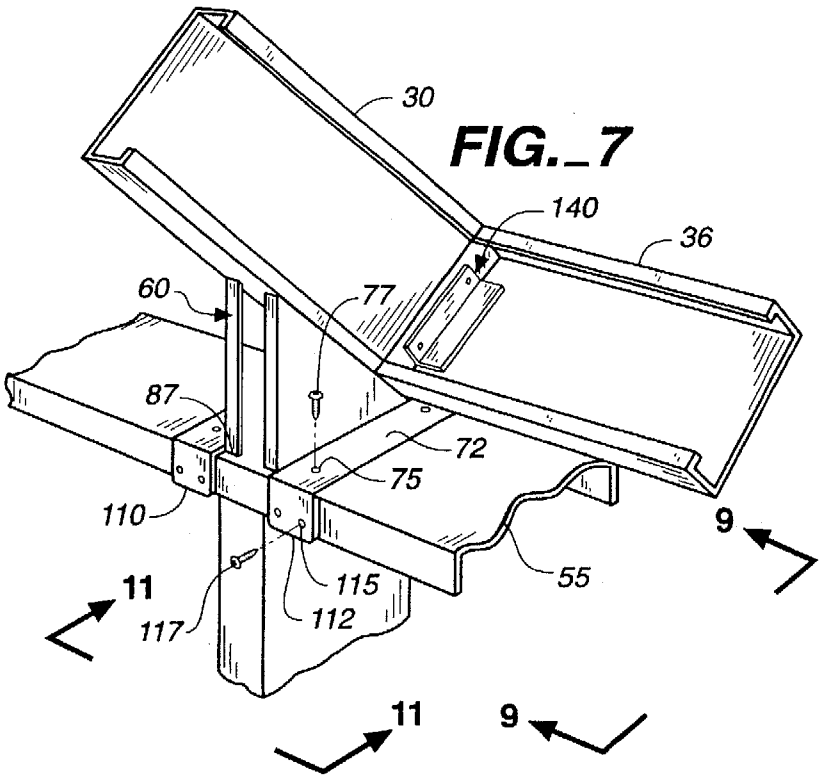
FIG. 7 is a reverse perspective view of the attachment of the roof assembly to the bearing member.
Figure 6:
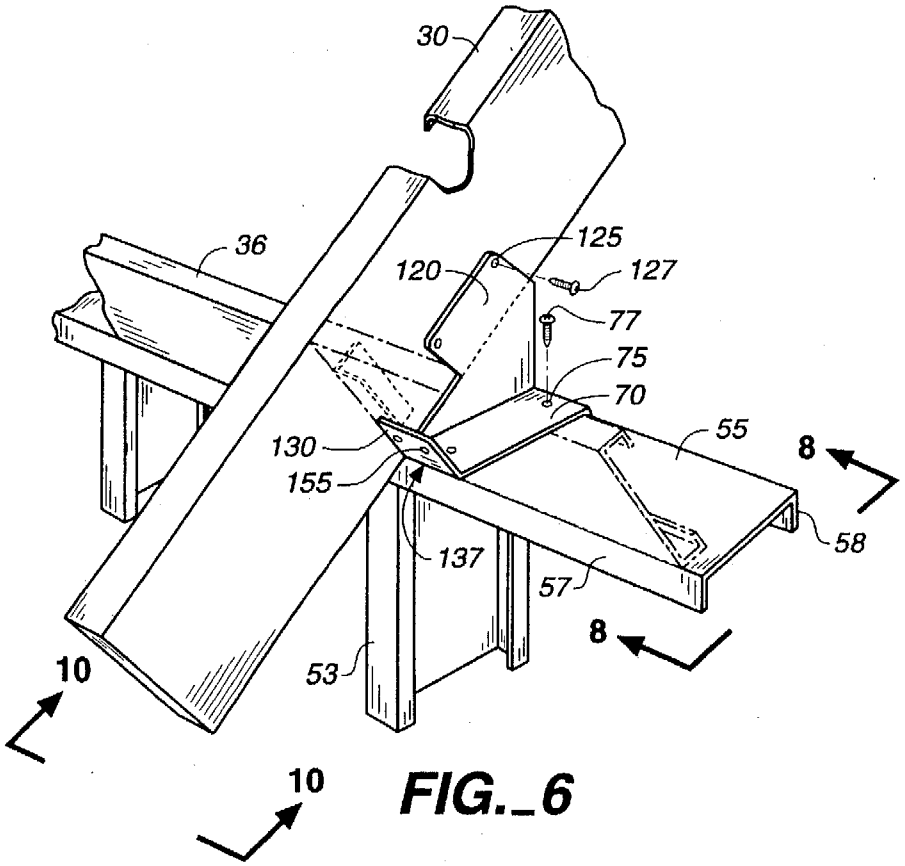
FIG. 6 is a perspective view, partially transparent, of the attachment of the roof assembly to the bearing member.
Figure 9:
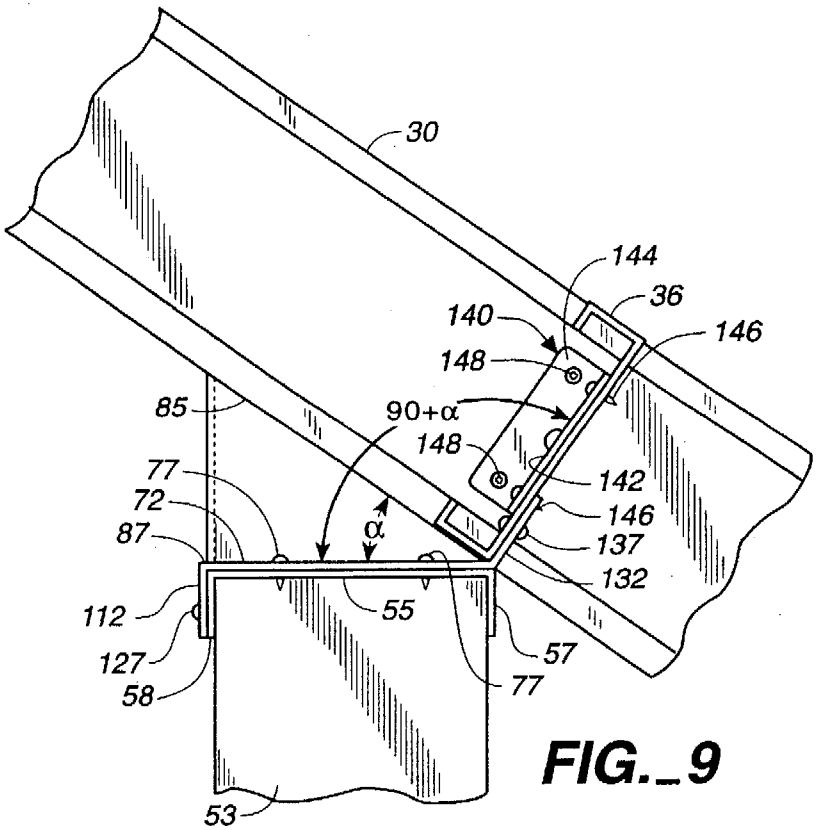
FIG. 9 is a back view along line 9—9 of FIG. 7.
Figure 8:
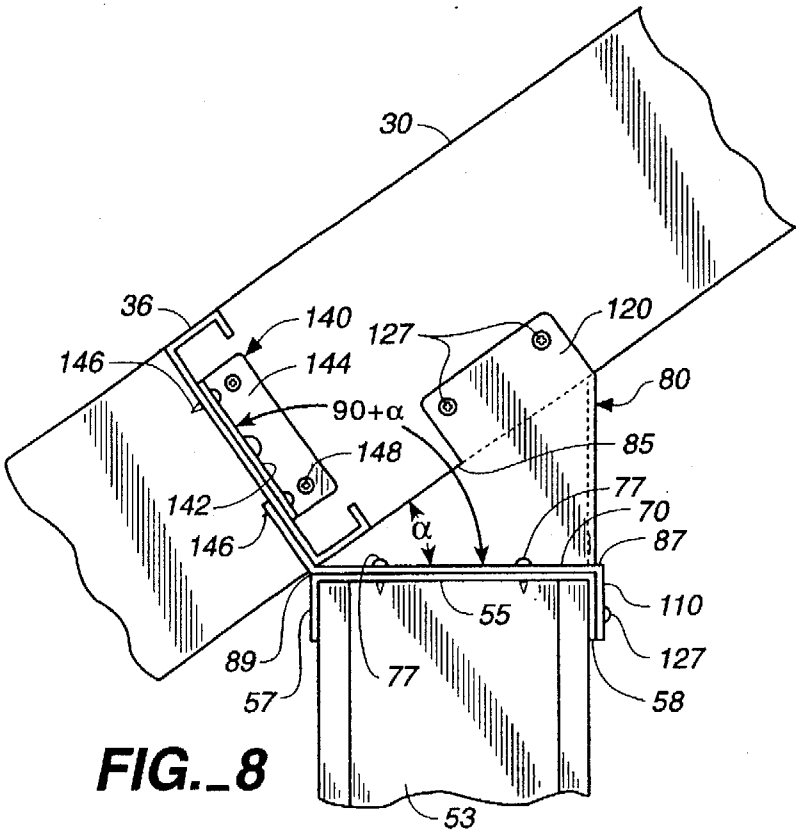
FIG. 8 is front view along line 8—8 of FIG. 6.
Figure 11:
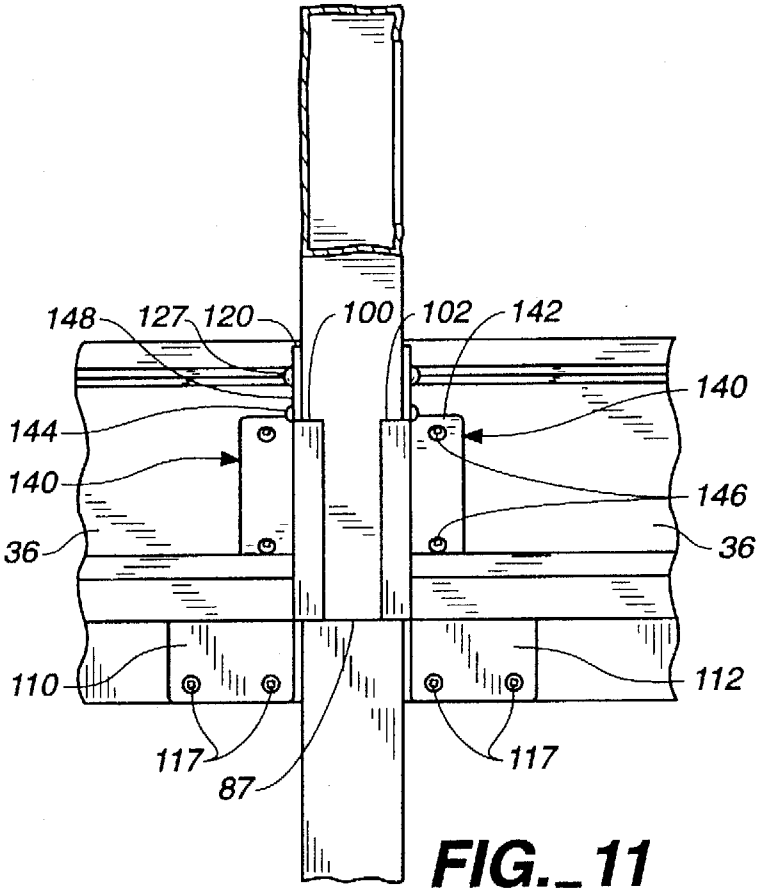
FIG. 11 is a side view along line 11—11 of FIG. 7
Figure 10:
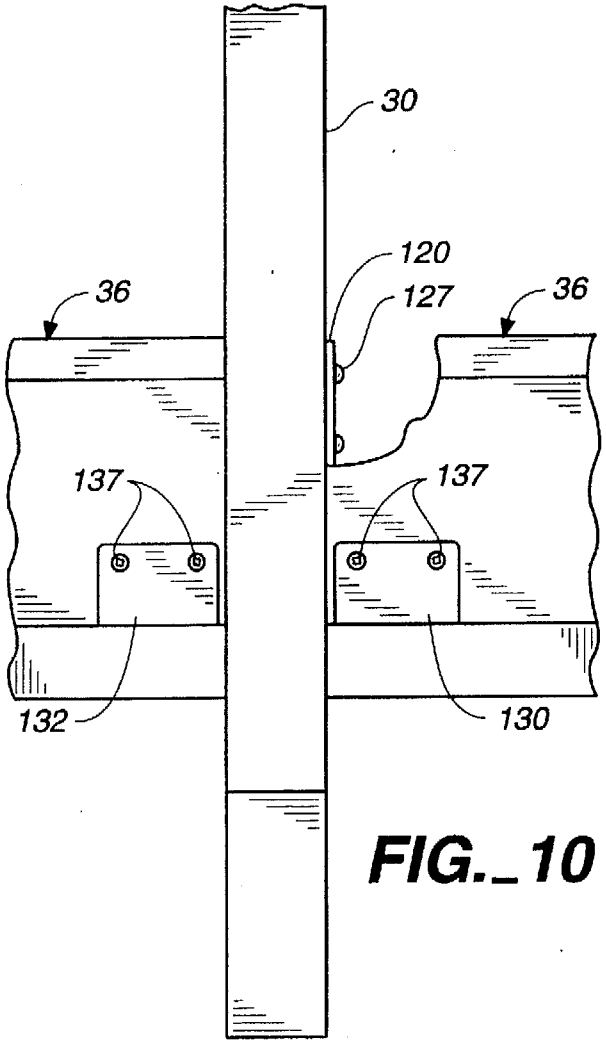
FIG. 10 is a side view along line 10—10 of FIG. 6.

As shown in FIGS. 6 and 7, each roof clip 60 is attached to bearing beam 55 by self-tapping screws 77 which fit through holes 75 in plates 70 and 72 (see also FIGS. 8 and 9). The inner edge 89 of ramp 80 may be aligned with or project beyond the outer edge 57 of bearing beam 55, but vertical holding tabs 110 and 112 are flush against the inner edge 58 of bearing beam 55. Clip 60 may be additionally secured to bearing beam 55 by self tapping screws 117 which fit through holes 115 in vertical holding tabs 110 and 112 (see also FIG. 11). Four self tapping screws 137 are inserted through holes 135 to secure blocking bar 36 to blocking tabs 130 and 132 (see also FIG. 10). Two self tapping screws 127 are inserted through holes 125 to secure rafter 30 to vertical securing tab 120 (see also FIG. 8).

As shown in FIGS. 8 and 9, the bearing surface 85 of ramp 80 forms an angle $\alpha$ with horizontal bearing beam 55. Since blocking bar 36 is preferably perpendicular to bearing surface 85, the blocking member will preferably form an angle $90+\alpha$ with horizontal bearing beam 55.

As shown in FIGS. 8–11, blocking bar 36 is connected to rafter 30 with L-brackets 140. Each L-bracket has a lateral face 142 and a dorsal face 144. Two self-tapping screws 146 pass through holes in dorsal face 142 to attach bracket 140 to blocking bar 36, and two self tapping screws 148 pass through holes in face 144 to attach bracket 140 to rafter 30. Blocking bar 36 may be fastened to rafters 30 by brackets 140 in a number of ways. Opposing brackets may both be attached to the "C"-shaped section of the rafter, and may be aligned or offset, or one bracket could be attached to metal sheet 38.

Blocking bar 36 could be attached to rafters 30 so that contact surface 42 is at an angle other than perpendicular to bearing surface 85. For example, contact surface 42 could be in a vertical plane perpendicular to bearing beam 55, independent of the angle of ramp 80.

Figure 12:
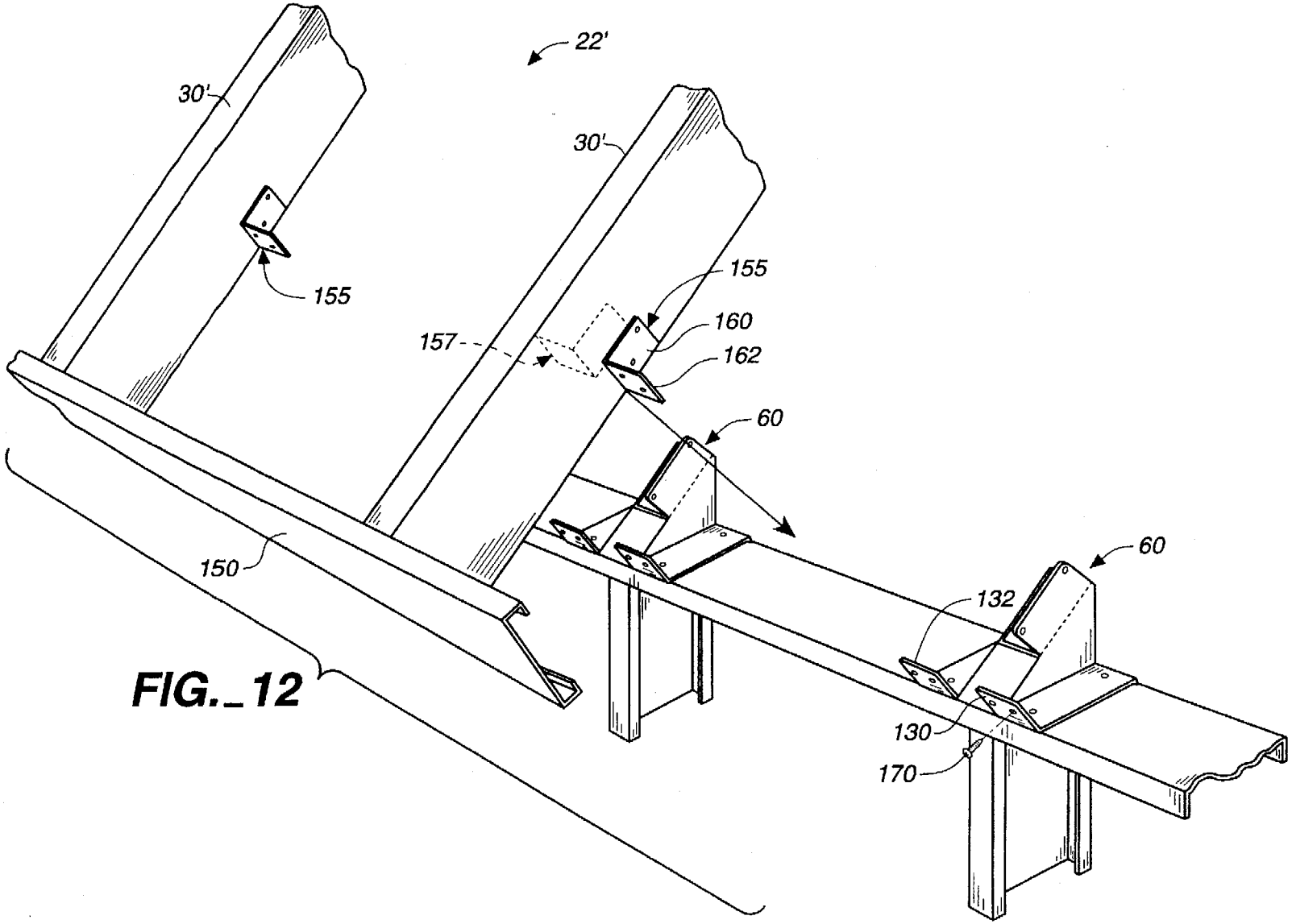
FIG. 12 is a perspective view of an alternate attachment of the roof assembly to the bearing member.

As shown in FIG. 12, in an alternate embodiment, lower lateral bar 150 is positioned at the end of rafter 30. Lower lateral bar 150 does not serve as a blocking member. Instead, the blocking member is a pair of opposing L-shaped brackets 155, 157. Each bracket has one face 160 fastened to rafter 30 by bolts, and a second face 162 which will be fastened to blocking tab 130 or 132. Frame 22' is lowered so that rafter 30' fits between blocking tabs 130 and 132 and rests on bearing surface 85 of ramp 80. Frame 22' is also maneuvered so that brackets 155 and 157 fit between vertical securing tab 120 and blocking tabs 130 and 132. When the tension on the frame is released, rafter 30 will slip down ramp 80 until contact surface 165 of brackets 155 and 157 contact the blocking tabs 130 and 132, respectively. Blocking tabs 130, 132 may then be attached to brackets 155, 157 by self tapping screws 170.

Numerous other embodiments are possible. For example, there might be two vertical securing tabs rather than one. The blocking tabs might not be located at the inner edge, but can be anywhere along ramp 80. For example, the blocking tab could be attached to the vertical securing tab. The clip could be formed out of multiple pieces welded or bolted together rather than out of a single metal sheet. The clip can be used to support a single pitched frame rather than a pair of pivotally attached frames.

What is claimed is:

1. A method of attaching a roof to a bearing beam of a building, comprising:

attaching a clip comprising a blocking tab to said bearing beam;

unfolding a roof assembly comprising two frames pivotally attached, at least one of said frames including a blocking member; and lowering said roof assembly so that said blocking member contacts said blocking tab to restrain further unfolding of said roof assembly.

2. The method of claim 1 wherein said clip further comprises a ramp and each of said frames includes a plurality of rafters, wherein said roof assembly is lowered so that a first rafter rests on said ramp.

3. The method of claim 2 wherein said blocking tab is perpendicular to a length of said first rafter.

4. The method of claim 2 further comprising the step of securing said blocking member to said blocking tab.

5. The method of claim 2 further comprising the steps of attaching a second clip comprising a second blocking tab and a second ramp to a second bearing beam of the building, and lowering said roof assembly so that a second rafter rests on said second ramp.

6. The method of claim 1 wherein said clip further comprises a vertical securing tab and one of said frames includes a rafter, and said method further comprises the step of securing said rafter to said vertical securing tab.

7. A roof, comprising:

first and second parallel bearing beams;

a first clip attached to said first bearing beam, said first clip comprising a first ramp and a first blocking tab;

a second clip attached to said second bearing beam, said second clip comprising a second ramp and a second blocking tab; and a roof assembly attached to said first and second bearing beams, said roof assembly comprising a first frame and a second frame pivotally attached, said first frame comprising a first rafter and a first blocking member, said second frame comprising a second rafter and a second blocking member, said first rafter supported by said first ramp and said first blocking member received by and attached to said first blocking tab, and said second rafter supported by said second ramp and said second blocking member received by and attached to said second blocking tab.

8. The roof according to claim 7 wherein said first clip further comprises a first vertical securing tab which is attached to said first rafter and said second clip further comprises a second vertical securing tab which is attached to said second rafter.

9. The roof according to claim 7 wherein said first and second blocking tabs are perpendicular to first and second lengths of said first and second rafters, respectively.

10. The roof according to claim 7 wherein said first and second blocking tabs form an angle $\alpha$ with said first and second bearing beams, respectively.

11. The roof according to claim 7 wherein said first frame further comprises a third rafter parallel to said first rafter and said second frame further comprises a fourth rafter parallel to said second rafter.

12. The roof according to claim 11 wherein said first blocking member comprises a first lateral beam connecting said first rafter to said third rafter and said second blocking member comprises a second lateral beam connecting said second rafter to said fourth rafter.

13. The roof according to claim 7 wherein said first blocking member comprises a first bracket positioned with a first face perpendicular to a length of said first rafter and said second blocking member comprises a second bracket positioned with a second face perpendicular to a length of said second rafter.

14. A clip for connecting a bearing beam to an inclined beam, comprising:

a base comprising a horizontal surface to rest against a first surface of said bearing beam;

a ramp with a face at an angle $\alpha$ less than ninety degrees to said horizontal surface to receive said inclined beam; and a blocking tab in a first plane perpendicular to said face of said ramp and at an angle $90+\alpha$ to said horizontal surface.

15. The clip according to claim 14 further comprising a securing tab in a second plane perpendicular to said horizontal surface.

16. The clip according to claim 14 further comprising a holding tab positioned on a side of said horizontal surface opposite from said ramp.

* * * * *